US006007211A

United States Patent [19]

Cheung

[11] Patent Number: 6,007,211

[45] Date of Patent: Dec. 28, 1999

[54] MOLDED ILLUMINATING DEVICE

[76] Inventor: James Cheung, 37-48 78th St., Jackson Heights, N.Y. 11372

[21] Appl. No.: 08/925,153

[22] Filed: Sep. 8, 1997

[51] Int. Cl.[6] ..... F21L 15/08

[52] U.S. Cl. ..... 362/103; 362/311; 362/800; 362/327; 362/278; 362/106

[58] Field of Search ..... 362/103, 105, 362/106, 108, 190, 191, 327, 186, 278, 800, 308, 309, 311

[56] References Cited

U.S. PATENT DOCUMENTS

| | | | |
|---|---|---|---|
| 3,205,350 | 9/1965 | Roszkowski et al. . | |
| 3,400,263 | 9/1968 | Yakim . | |
| 4,556,932 | 12/1985 | Lehrer et al. | 362/103 |
| 4,600,975 | 7/1986 | Roberts | 362/147 |
| 5,285,586 | 2/1994 | Goldston et al. | 36/137 |
| 5,349,503 | 9/1994 | Blonder et al. | 362/31 |
| 5,436,817 | 7/1995 | Wotton et al. . | |
| 5,508,899 | 4/1996 | McCormick | 362/103 |
| 5,567,037 | 10/1996 | Ferber . | |
| 5,704,706 | 1/1998 | Goldston et al. | 362/103 |
| 5,722,757 | 3/1998 | Chein | 362/32 |
| 5,806,957 | 9/1998 | Prior et al. | 362/61 |

*Primary Examiner*—Sandra O'Shea
*Assistant Examiner*—John Anthony Ward
*Attorney, Agent, or Firm*—Michael I. Kroll

[57] ABSTRACT

A molded illuminating device (12) comprising a housing (14) molded into any desired shape and form. A facility (16) within the housing (14) is for illuminating the housing (14). A structure (18) is for attaching the housing (14) to an article (20) that requires illumination for a novelty effect and safety visibility.

7 Claims, 3 Drawing Sheets

Fig. 3
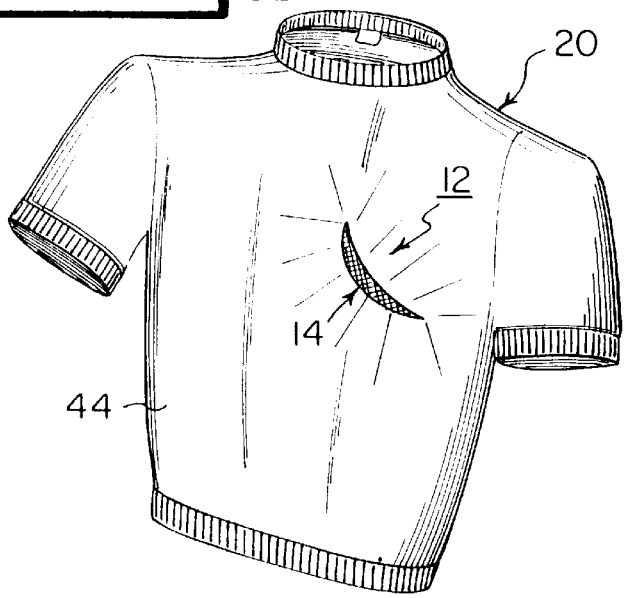
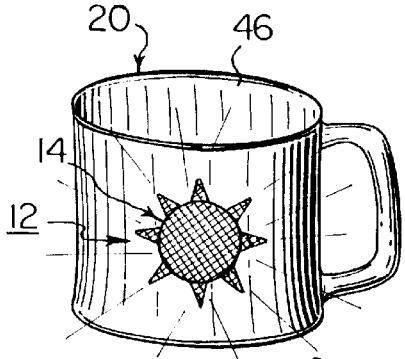
Fig. 4
Fig. 5
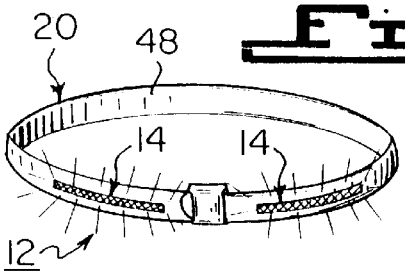
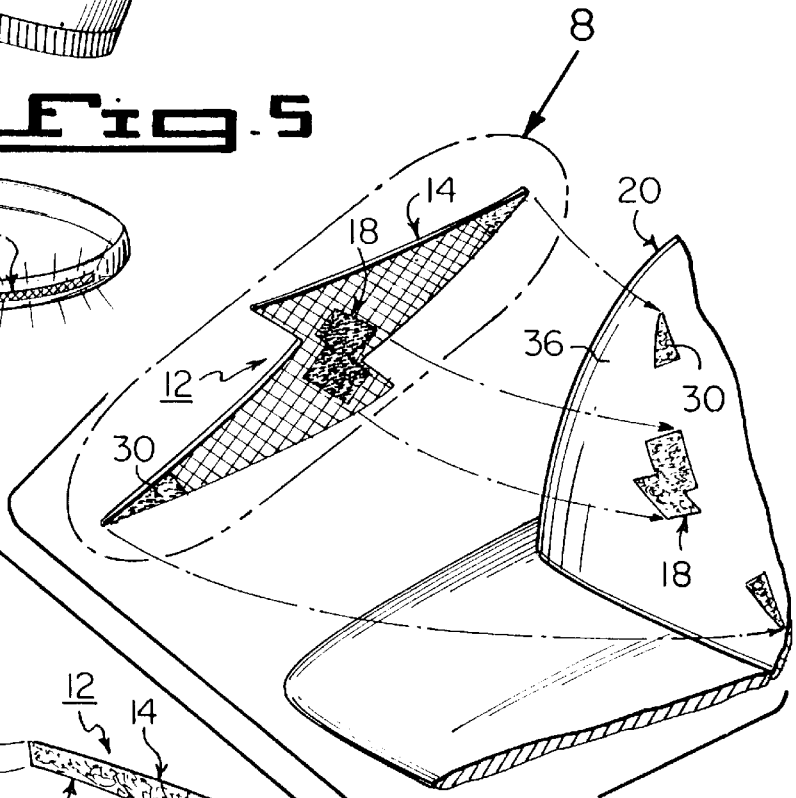
Fig. 6
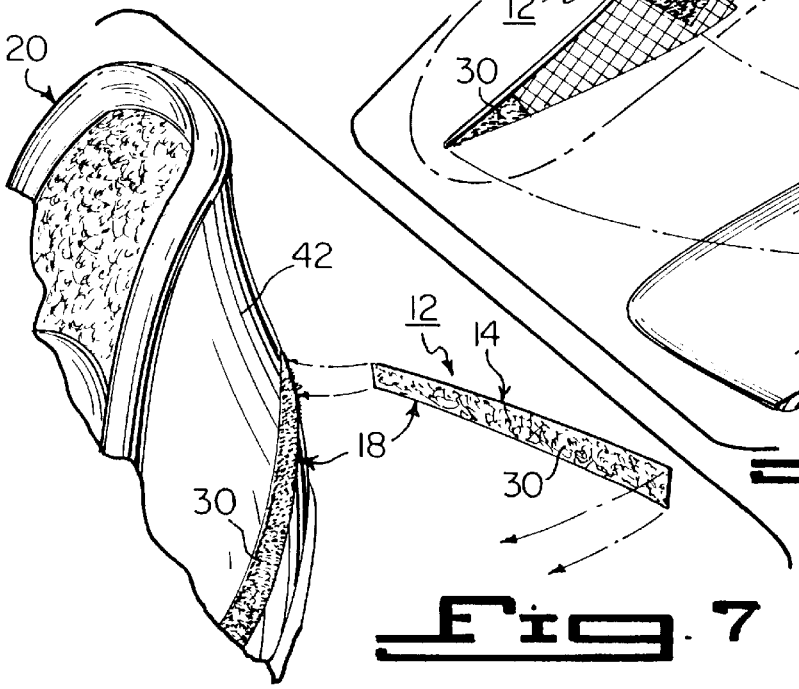
Fig. 7

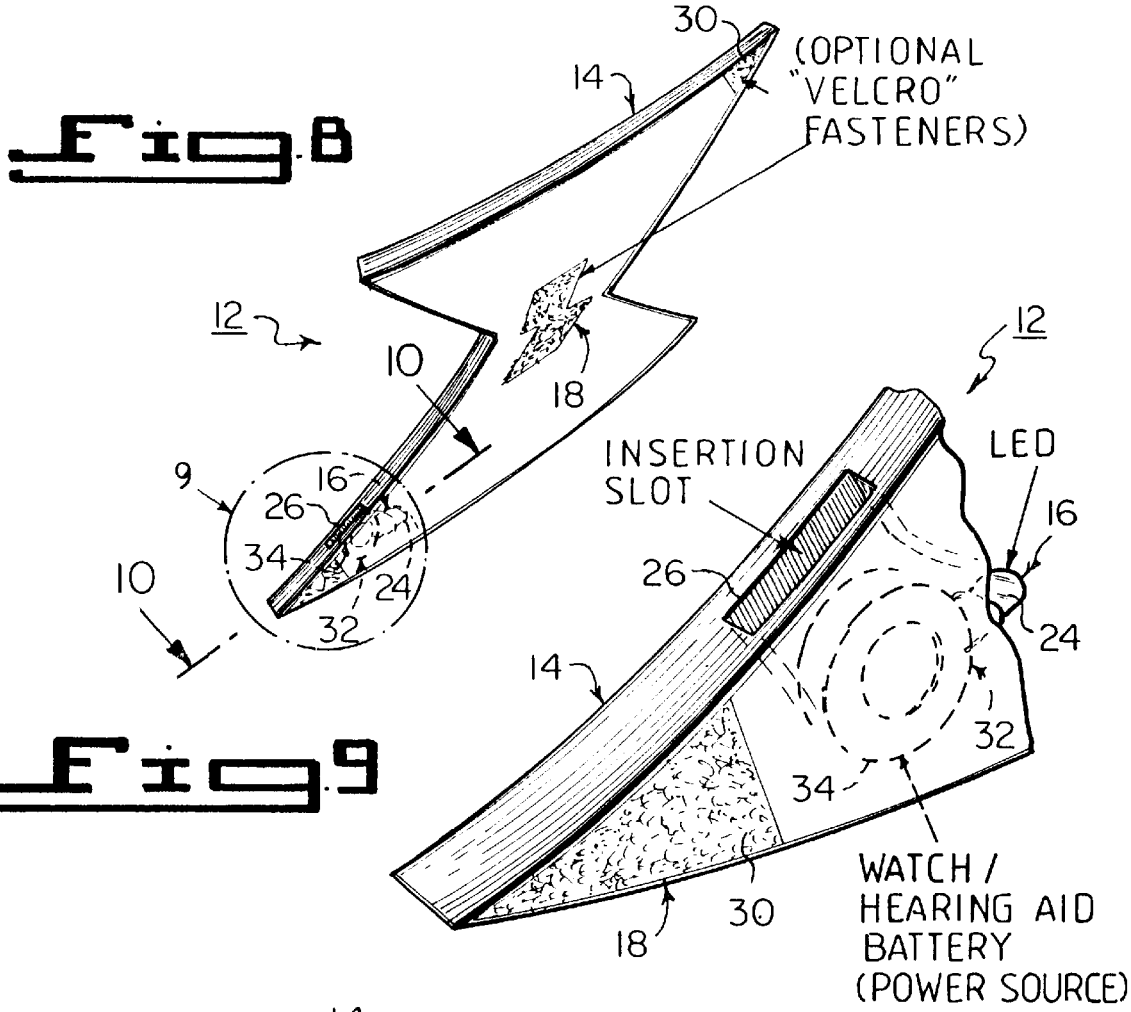
Fig. 8
Fig. 9
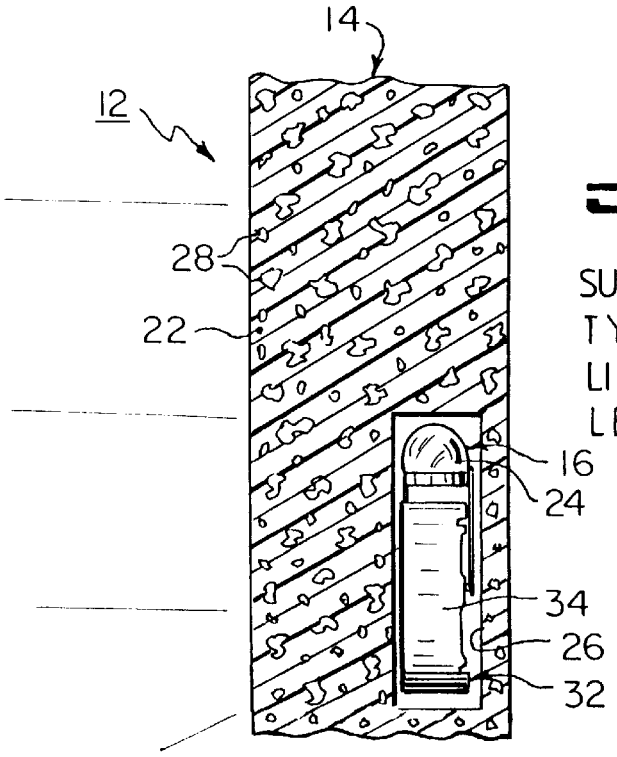
Fig. 10
SUBSTANTIALLY ENLARGED TYPICAL SECTION SHOWS LIGHT DISPERSION FROM LED

MOLDED ILLUMINATING DEVICE

BACKGROUND OF THE INVENTION

1. Field of the Invention

The instant invention relates generally to light transmitting systems and more specifically it relates to a molded illuminating device. The molded illuminating device consists of a light source in a housing with tiny reflective particles to increase illumination when activated. The device can be molded into various shapes and attached to different types of articles that require illumination.

2. Description of the Prior Art

Numerous light transmitting systems have been provided in prior art. For example, U.S. Pat. Nos. 3,205,350 to Roszkowski et al.; 3,400,263 to Yakim; 5,419,061 to Barrocas; 5,508,899 to McCormick; 5,436,817 to Wotton et al. and 5,567,037 to Ferber all are illustrative of such prior art. While these units may be suitable for the particular purpose to which they address, they would not be as suitable for the purposes of the present invention as heretofore described.

ROSZKOWSKI, GEORGE

ROSZKOWSKI, GREGORY JOHN

ILLUMINATED FIGURINE

U.S. Pat. No. 3,205,350

A decorative figurine comprising a hollow base having a permanent magnet mounted therein for releasably securing the base to a paramagnetic surface. A source of electrical power is in the base. A switch is electrically connected to the power source. An upstanding body is attached to the base and has the shape of a saint or the like and includes a head. The head has a flat surface thereon and the body has an opening therein which at one end communicates with the flat surface. The opening passes through the body and at its other end communicates with the hollow base. A circular halo disk of translucent material has a generally flat surface on one side thereof which engages the flat head surface. The halo disk further has a centrally disposed blind opening therein communicating and aligned with the opening in the body. An electrically energizable lamp bulb is located at least in part in the central blind opening of the halo disk. Wires passing through the opening in the body electrically connect the lamp bulb to the power source through the switch. A disk of opaque material at least partially covers the side of the halo disk opposite from the flat surface. The disk of opaque material being concentric with the halo disk.

YAKIM CHARLES

ORNAMENTAL ILLUMINATED COLOR STAR LIGHT

U.S. Pat. No. 3,400,263

An illuminated star consisting of an intermediate flat rigid star-shaped frame with a center in the form of an open pentagon and open triangular points on the sides of the pentagon. Each point has a straight intermediate cross arm parallel to the associated pentagon side. Different colored outwardly projecting lamps are mounted in the points and on the mid portions of the respective sides of the pentagon in radial alignment. Additional inwardly projecting colored lamps are mounted on the corners of the pentagon and on the mid portions of the pentagon sides, forming an inner pentagon concentric with the frame pentagon. A pair of outwardly convex star-shaped translucent covers are secured to the opposite side surfaces of the frame. The lamps are wire so that groups of lamps of common color may be simultaneously energized, and so that the respective groups may be sequentially energized.

BARROCAS, JOSE E.

LIGHTED INSERT FOR FOOTWEAR AND METHOD

U.S. Pat. No. 5,419,061

A clear or translucent U-shaped insert has embedded within its cavity a light emitting module. The insert is preferably manufactured of polyvinyl chloride and conforms to the shape of the heel portion of footwear manufactured under the process of injection molding using polyvinyl chloride as the injected molten material. The light emitting module comprises a power source, electrical contacts, a plurality of light emitting devices and a switch engaging means. The insert is permanently molded into the sole of the footwear about the heel such that when the switch engaging means illuminates the light emitting devices, the devices can be viewed from the exterior of the footwear.

McCORMICK, ARNOLD J.

SHOE LIGHT ATTACHMENT

U.S. Pat. No. 5,508,899

An attachment for a shoe or boot includes a wishbone or spur element that fits around the quarters (or foxing or outer counter portion, depending upon its construction) of the shoe or boot. The element carries lamps that are visible when viewed toward the back of the shoe. The lamps are electrically connected to a source of current, generally a battery, which is carried either by the element itself, or by a casing to which the element is adjustably attached. The wishbone or spur element is preferably mounted by or aided in its mounting by a hook and loop fastener of the type sold under the trademark VELCRO.

WOTTON, MICHAEL C.

ZINBARG, BENSON E.

RECESSED LAMP SOCKET SYSTEM FOR ILLUMINATED DECORATIVE FIGURES

A lamp socket system for an illuminated decorative figure includes a lamp socket with an integral male electrical plug and a flange for mounting the socket in a hole in the decorative figure. The decorative figure is provided with a well surrounding a hole in which the socket is mounted. The well is large enough to accommodate the female end connector of an extension cord and may be provided with an oblong radially extending portion to accommodate an oblong female end connector. When the socket is installed in the hole in the figure and an extension cord is connected to the integral male plug on the socket, the electrical connection between the extension cord and the socket is sheltered by the well. The well protects the electrical connection from rain, snow, and other environmental elements. It also supports the weight of the female end connector of the extension cord, so that the socket is not pulled out of the figure. Since the socket is installed at the interior end of the well, it does not protrude from the outer surface of the figure. The socket is thereby protected from damage during shipping and storage of the decorative figure. The decorative figures can be manufactured using conventional molding techniques to provide the well for receiving the socket. The socket can be insert molded with inserted conductive prongs, or can be assembled from several pieces. A fuse may be provided in the socket and the conductive prongs may be partially shrouded.

FERBER. ANDREW R.

LED FOR INTERFACING AND CONNECTING TO CONDUCTIVE SUBSTRATES

U.S. Pat. No. 5,567,037

An illumination device for enhancing the structural and aesthetic appearance of associated articles or substrates and to provide operative coaction with conductive current paths made from conductive paints, inks and the like compositions on such articles and substrates is disclosed. The illumination device comprises an LED having leads, the LED and at least one portion of the leads are encapsulated within a substantially nonconductive relatively transparent or translucent housing. At least a second portion of the leads of the LED extend outside of the housing and are arranged substantially flush along an exterior surface of the housing, so that when the housing is connected by suitable connectors to the associated article or substrate, electrical communication with an external power source can be established for operating and actuating the LED.

SUMMARY OF THE INVENTION

A primary object of the present invention is to provide a molded illuminating device that will overcome the shortcomings of the prior art devices.

Another object is to provide a molded illuminating device that consists of a light source in a housing made of transparent or translucent material with tiny reflective particles embedded therein, to increase illumination when the light source is activated.

An additional object is to provide a molded illuminating device in which the housing can be molded into various sizes and shapes and can be attached to different types of articles that require illumination for a novelty effect or safety visibility.

A further object is to provide a molded illuminating device that is simple and easy to use.

A still further object is to provide a molded illuminating device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 3 is a perspective view showing the instant invention in the shape of a crescent moon attached to a shirt.

FIG. 4 is a perspective view showing the instant invention in the shape of a sun attached to a drinking cup.

FIG. 5 is a perspective view showing the instant invention in the shape of two rectangular strips attached to a belt.

FIG. 6 is an enlarged perspective view of an area of FIG. 1 as indicated by arrow 6, with the instant invention exploded therefrom.

FIG. 7 is an enlarged perspective view of an area of FIG. 2 is indicated by arrow 7, with the instant invention exploded therefrom.

FIG. 8 is a further enlarged perspective view of an area of FIG. 6 as indicated by arrow 8, being the instant invention per se.

FIG. 9 is a still further enlarged perspective view of an area of FIG. 8, as indicated by arrow 9 in FIG. 8.

FIG. 10 is an enlarged cross sectional view taken along line 10—10 in FIG. 9, with parts broken away.

Similar reference characters denote corresponding features consistently throughout the attached drawings.

DESCRIPTION OF THE PREFERRED EMBODIMENTS

Figure 1:
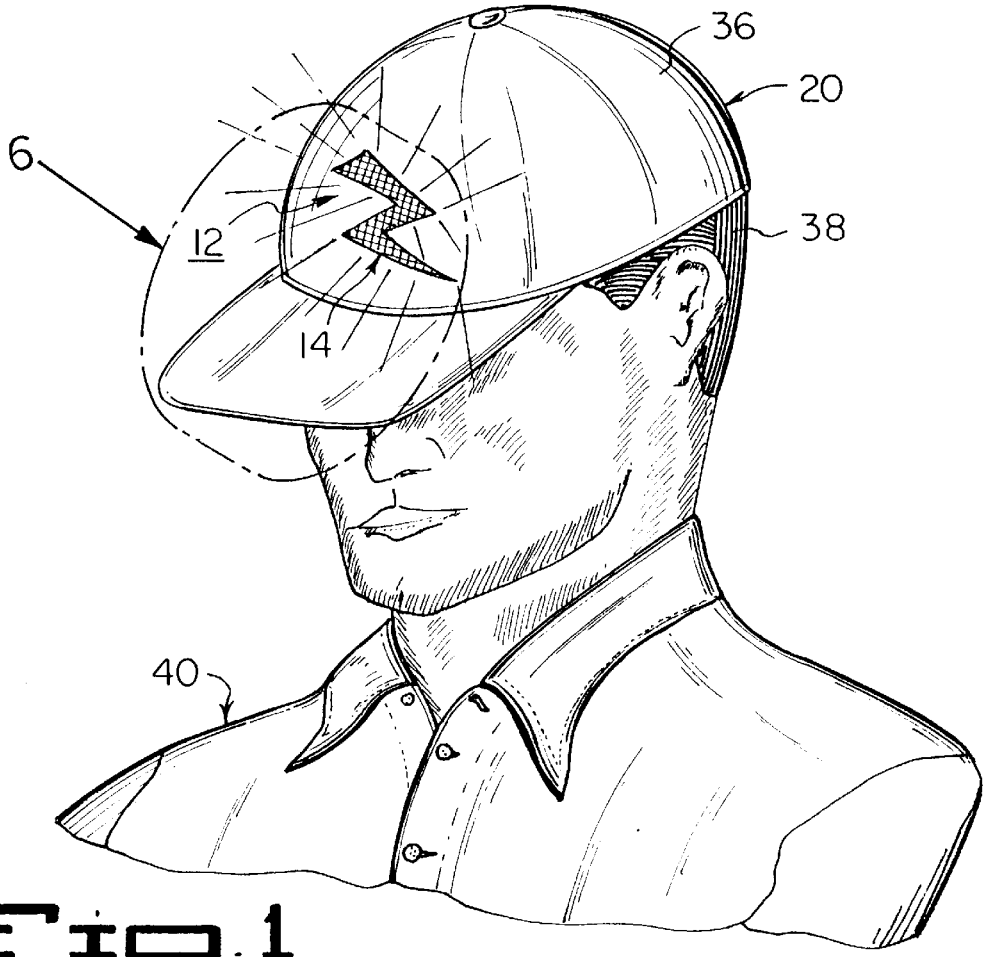
FIG. 1 is a perspective view showing the instant invention in the shape of a lightening bolt attached to a cap worn on the head of a person.

Turning now descriptively to the drawings, in which similar reference characters denote similar elements throughout the several views, FIGS. 1 through 10 illustrate a molded illuminating device 12 of the present invention. With regard to the reference numerals used, the following numbering is used throughout the various drawing figures.

12 molded illuminating device
14 housing of 12
16 illuminating facility of 12
18 attaching structure of 12
20 article
22 polyvinyl chloride material for 14
24 light emitting diode for 16
26 insertion slot in 14
28 tiny reflective particles embedded in 14
30 VELCRO fastener
32 power source
34 battery for 32
36 cap for 20
38 head of 40
40 person
42 shoe for 20
44 shirt for 20
46 drinking cup for 20
48 belt for 20

The molding illuminating device 12 comprises a housing 14 molded into any desired shape and form. A facility 16 within the housing 14 is for illuminating the housing 14. A structure 18 is for attaching the housing 14 to an article 20 that requires illumination for a novelty effect and safety visibility.

The housing 14 can be fabricated out of a transparent or translucent material. The translucent material can be impregnated with a dye. The housing 14 can be made from a hard resin or semi-hard resin, which can be a polyvinyl chloride material 22. The housing can be cast in a mold or processed by injection molding.

The illuminating facility 16 is a light emitting diode 24. The housing 14 has an insertion slot 26 to receive the light emitting diode 24 therein.

As shown in FIG. 10, the housing 14 includes a plurality of tiny reflective particles 28 imbedded therein, that act as tiny mirrors to reflect light from the light emitting diode 24 to increase its brightness.

The attaching structure 18 consists of a plurality of VELCRO fasteners 30, for holding the housing 14 in a removable manner to the article 20. Other types of fasteners not shown in the drawings can be utilized, such as glue, sewing or snaps. A power source 32 can be carried within the housing 14, to supply electricity to the light emitting diode 24. The power source 32 is a battery 34, electrically connected to the light emitting diode 24. The power source 32 can also be located outside of the housing 14 and electrically connected to the llight emitting diode 24.

Figure 2:
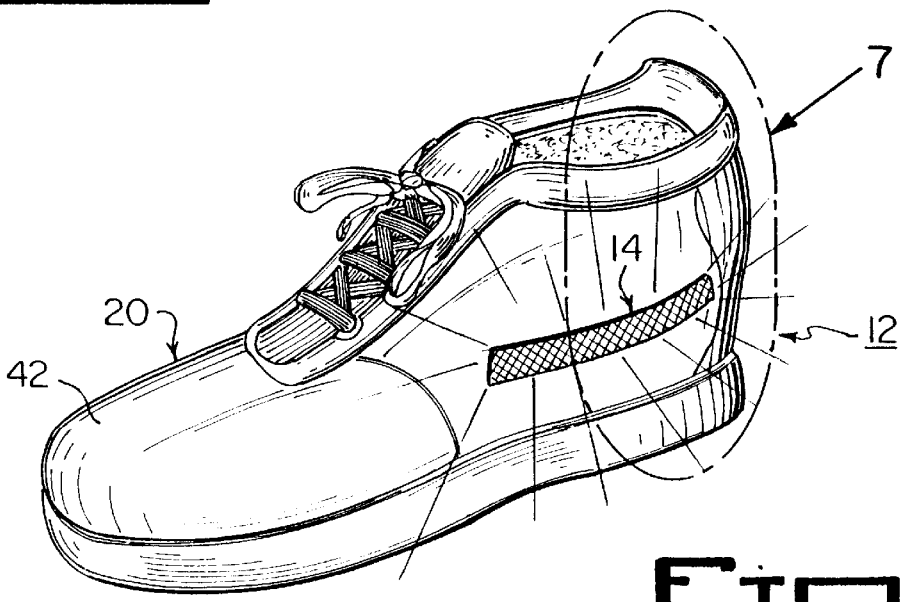
FIG. 2 is a perspective view showing the instant invention in the shape of a rectangular strip attached to one side of a shoe.

The article 20, as shown in FIGS. 1 and 6, is a cap 36 worn on the head 38 of a person 40. The article 20, as shown in FIGS. 2 and 7, is a shoe 42. The article 20 as shown in FIG. 3, is a shirt 44, in FIG. 4 a drinking cup 46 and in FIG. 5 a belt 48. Other articles 20 not illustrated in the drawings, can also be utilized in conjunction with the instant invention. The housing 14 in FIGS. 1, 6 and 8, is shaped as a lightening bolt. The housing in FIGS. 2, 5 and 7, is shaped as a rectangular strip. The housing 14 is shaped as a crescent moon in FIG. 3 and a sun in FIG. 4. Other geometric shapes not shown in the drawings, can also be made out of the housing 14.

OPERATION OF THE INVENTION

To use the molded illuminating device 12, the following steps should be taken:

1. Impregnate polyvinyl chloride material 22 with the tiny reflective particles 28.
2. Form the housing 14 with the insertion slot 26 into any geometric shape desired.
3. Connect the battery 34 to the light emitting diode 24.
4. Place the light emitting diode 24 and the battery 34 into the insertion slot 26 in the housing 14.
5. Attach the VELCRO fasteners 30 onto the housing 14 and the article 20 to be used.
6. Mate the VELCRO fasteners 30 together.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A molded illuminating device comprising:

a) a solid housing molded into a preselected shape adapted to be mounted on the outside of an article and made from a transparent or translucent material;

b) means within said housing for illuminating said housing comprising a slot and a lighting assembly removably inserted into said slot, said lighting assembly comprising a light emitting diode connected to a battery;

c) means for attaching said housing to said article; and d) a plurality of tiny reflective particles dispersed within and throughout said solid housing so that light from said light emitting diode is reflected by said particles.

2. A molded illuminating device as recited in claim 1, wherein said material is impregnated with a dye.

3. A molded illuminating device as recited in claim 1, wherein said housing is made from a hard resin.

4. A molded illuminating device as recited in claim 1, wherein said housing is made from a semi-hard resin.

5. A molded illuminating device as recited in claim 1, wherein said housing is made from a polyvinyl chloride material.

6. A molded illuminating device as recited in claim 1, wherein said housing is cast in a mold.

7. A molded illuminating device as recited in claim 1, wherein said housing is processed by injection molding.

* * * * *